US012742312B2

(12) United States Patent
Takenaka

(10) Patent No.: US 12,742,312 B2
(45) Date of Patent: Sep. 22, 2026

(54) WORK MACHINE AND METHOD FOR CONTROLLING WORK MACHINE

(71) Applicant: KOMATSU LTD., Tokyo (JP)

(72) Inventor: Yuita Takenaka, Tokyo (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 19/119,183

(22) PCT Filed: Sep. 25, 2023

(86) PCT No.: PCT/JP2023/034666

§ 371 (c)(1),
(2) Date: Apr. 8, 2025

(87) PCT Pub. No.: WO2024/080113

PCT Pub. Date: Apr. 18, 2024

(65) Prior Publication Data

US 2026/0139458 A1 May 21, 2026

(30) Foreign Application Priority Data

Oct. 14, 2022 (JP) ..... 2022-165541

(51) Int. Cl.
*E02F 9/26* (2006.01)
*E02F 9/08* (2006.01)
*E02F 9/22* (2006.01)

(52) U.S. Cl.
CPC ..... *E02F 9/264* (2013.01); *E02F 9/0841* (2013.01); *E02F 9/225* (2013.01); *E02F 9/2267* (2013.01)

(58) Field of Classification Search
CPC ..... E02F 9/264; E02F 9/0841; E02F 9/225; E02F 9/2267
See application file for complete search history.

(56) References Cited

U.S. PATENT DOCUMENTS 5,908,081 A * 6/1999 Olson ..... B62D 9/00 180/419
6,401,456 B1 6/2002 Moriya et al.
(Continued)

FOREIGN PATENT DOCUMENTS

JP 2000-027812 A 1/2000
JP 2007-278490 A 10/2007
(Continued)

*Primary Examiner* — Joseph J Dallo
(74) *Attorney, Agent, or Firm* — Faegre Drinker Biddle & Reath LLP

(57) ABSTRACT

A work machine includes: a detection unit that detects an articulation angle; a hydraulic cylinder for steering; an operation apparatus that receives an input of an operation command from an operator to drive the hydraulic cylinder for steering; a control valve that controls an amount of driving of the hydraulic cylinder for steering; and a controller that outputs a command current that causes the control valve to operate in response to the operation command of the operation apparatus. The controller executes a calibration mode for correcting the command current corresponding to the operation command of the operation apparatus and causing the control valve to operate. In the calibration mode, the controller cuts off the command current to the control valve when the articulation angle becomes equal to or larger than a prescribed angle.

7 Claims, 14 Drawing Sheets

(56) References Cited

U.S. PATENT DOCUMENTS

| | | | | |
|---|---|---|---|---|
| 2004/0093139 | A1* | 5/2004 | Wildey | B62D 12/00 701/41 |
| 2014/0182277 | A1* | 7/2014 | Kuipers | B62D 9/00 60/327 |
| 2014/0214278 | A1* | 7/2014 | Kuipers | G05B 13/00 701/42 |
| 2014/0343697 | A1* | 11/2014 | Kuipers | B60W 50/16 700/83 |
| 2016/0281331 | A1 | 9/2016 | Ikegami et al. | |
| 2018/0027734 | A1* | 2/2018 | Hien | G01F 1/30 |
| 2018/0118256 | A1* | 5/2018 | Ge | B62D 12/00 |
| 2018/0251959 | A1 | 9/2018 | Fujii et al. | |
| 2020/0141089 | A1 | 5/2020 | Muraoka et al. | |
| 2022/0106770 | A1 | 4/2022 | Muraoka et al. | |
| 2023/0064337 | A1* | 3/2023 | Tevis | E02F 9/262 |
| 2023/0145883 | A1 | 5/2023 | Hirama et al. | |

FOREIGN PATENT DOCUMENTS

| | | | |
|---|---|---|---|
| JP | 2011-196070 | A | 10/2011 |
| JP | 2017-190858 | A | 10/2017 |
| JP | 2018-189104 | A | 11/2018 |
| JP | 2020-128733 | A | 8/2020 |
| JP | 2022-15783 | A | 1/2022 |
| WO | 2015/137524 | A1 | 9/2015 |
| WO | 2018/087830 | A1 | 5/2018 |

* cited by examiner (A)

(B)

WORK MACHINE AND METHOD FOR CONTROLLING WORK MACHINE

TECHNICAL FIELD

The present disclosure relates to a calibration mode of a work machine.

BACKGROUND ART

Conventionally, various types of calibration work have been performed in a work machine in consideration of individual difference. Various schemes to calibrate an operation of a hydraulic actuator of a work implement that operates in accordance with an operation electric signal from an operation apparatus in a hydraulic excavator, which is a work machine, have been proposed (refer to PTLs 1 to 4).

Regarding the calibration work, a scheme to start or interrupt a calibration process by operating a start button or a clear button provided on a display screen of a work machine has also been proposed (refer to PTL 5).

CITATION LIST

Patent Literature

PTL 1: WO 2018/087830
PTL 2: Japanese Patent Laying-Open No. 2000-027812
PTL 3: Japanese Patent Laying-Open No. 2007-278490
PTL 4: Japanese Patent Laying-Open No. 2018-189104
PTL 5: WO 2015/137524

SUMMARY OF INVENTION

Technical Problem

When a calibration mode is started by operating a display screen of a work machine having a steering system at the time of a calibration process for the work machine, a steering spool operates automatically, and thus, steering operates automatically.

In a work machine such as an articulated wheel loader, when steering operates automatically, the work machine may interfere with a surrounding object depending on the situation.

An object of the present disclosure is to provide a work machine and a method for controlling a work machine that enable execution of a calibration mode without affecting the surroundings of the work machine.

Solution to Problem

A work machine based on an aspect of the present disclosure includes: a detection unit that detects an articulation angle; a hydraulic cylinder for steering; an operation apparatus that receives an input of an operation command from an operator to drive the hydraulic cylinder for steering; a control valve that controls an amount of driving of the hydraulic cylinder for steering; and a controller that outputs a command current that causes the control valve to operate in response to the operation command of the operation apparatus. The controller executes a calibration mode for correcting the command current for the operation command of the operation apparatus and causing the control valve to operate. In the calibration mode, the controller cuts off the command current to the control valve when the articulation angle becomes equal to or larger than a prescribed angle.

A method for controlling a work machine based on an aspect of the present disclosure includes: detecting an articulation angle; receiving an input of an operation command of an operation apparatus from an operator to drive a hydraulic cylinder for steering; outputting a command current that causes a control valve to operate in response to the operation command, the control valve being a valve that controls an amount of driving of the hydraulic cylinder for steering; executing a calibration mode for correcting the command current for the operation command and causing the control valve to operate; and in the calibration mode, cutting off the command current to the control valve when the articulation angle becomes equal to or larger than a prescribed angle.

Advantageous Effects of Invention

The work machine and the method for controlling the work machine according to the present disclosure enable execution of a calibration mode without affecting the surroundings of the work machine.

DESCRIPTION OF EMBODIMENTS

Figure 1:
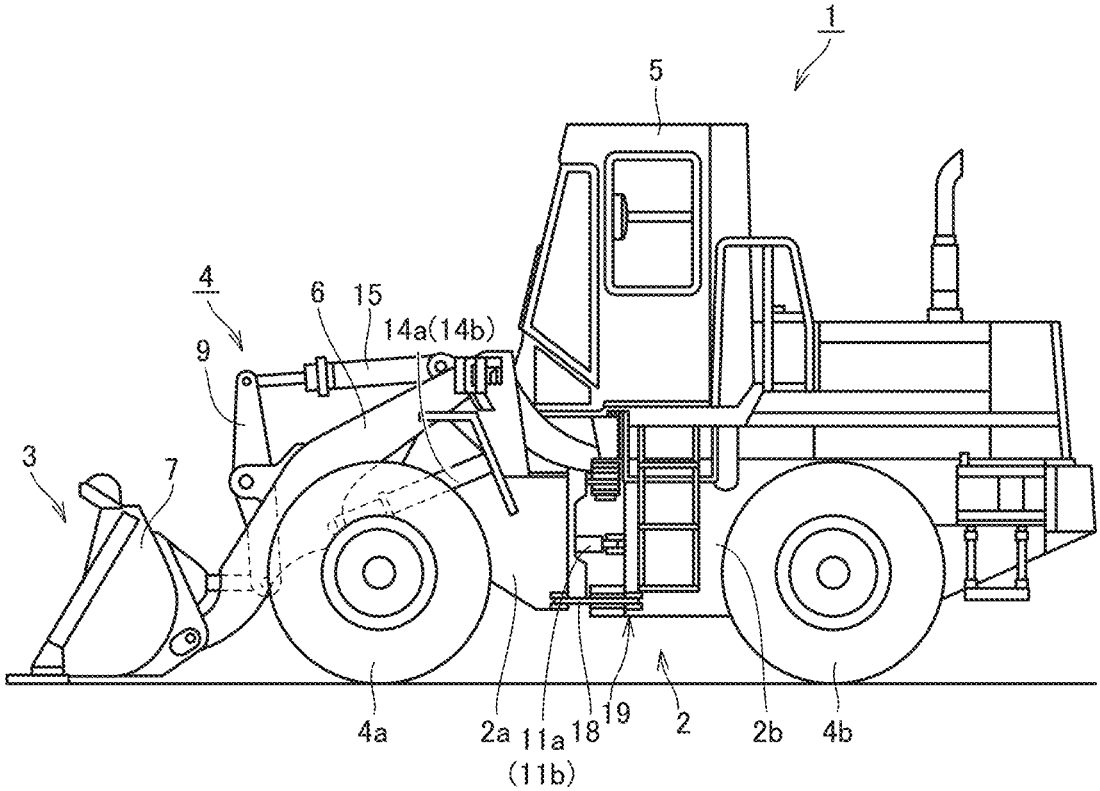
FIG. 1 is an external view of a wheel loader 1 based on a first embodiment.

Hereinafter, embodiments will be described with reference to the drawings. In the following description, the same components have the same reference characters allotted, and their labels and functions are also the same. Therefore, detailed description thereof will not be repeated.

First Embodiment

<Overall Configuration of Work Machine>

FIG. 1 is an external view of a wheel loader 1 based on a first embodiment.

Figure 2:
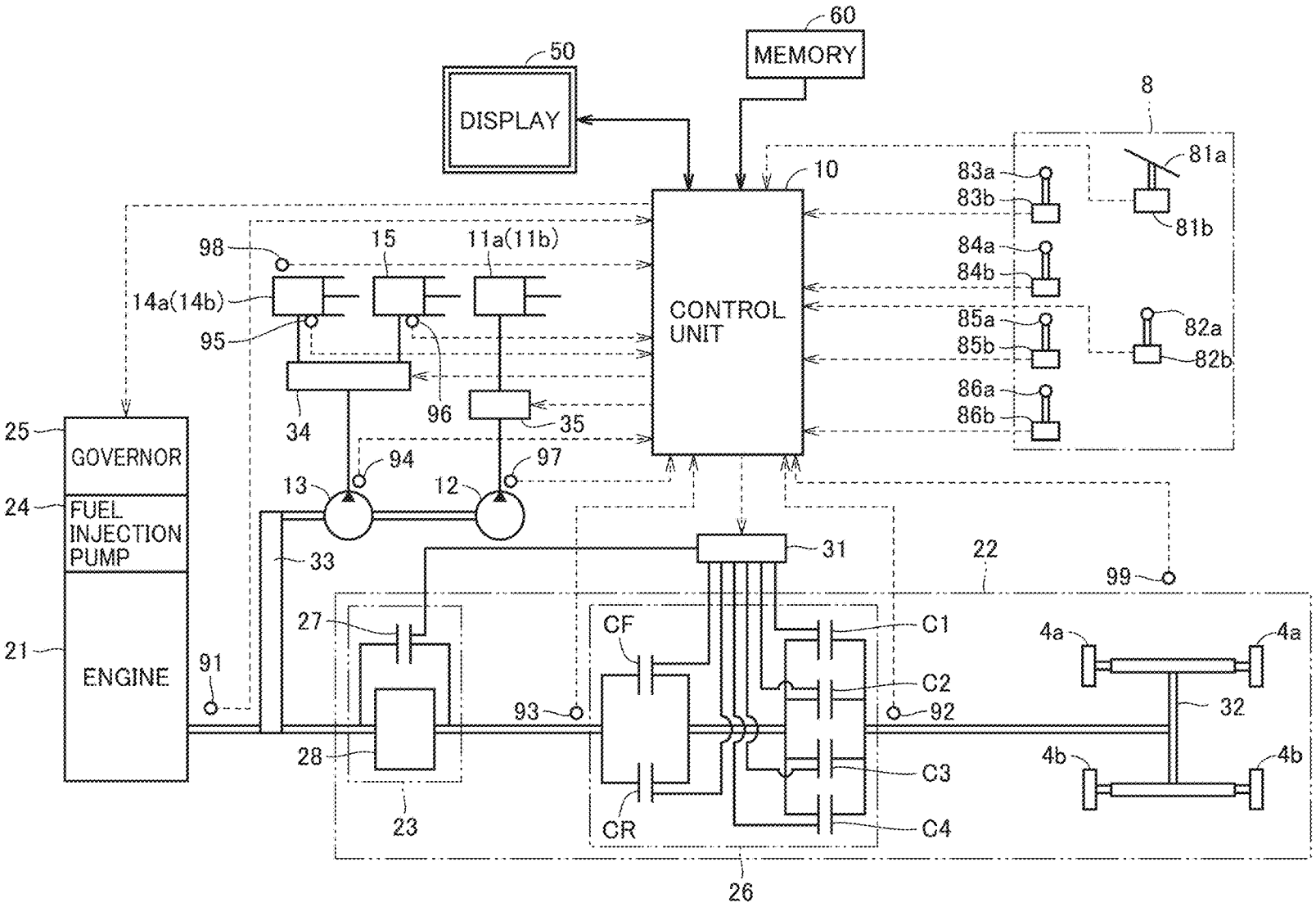
FIG. 2 is a schematic view showing a configuration of wheel loader 1 based on the first embodiment.

FIG. 2 is a schematic view showing a configuration of wheel loader 1 based on the first embodiment.

As shown in FIG. 1, wheel loader 1 including a work implement 3 activated by hydraulic pressure is described as an example of a work machine to which the idea of the present disclosure is applicable.

In the following description, the terms "upper", "lower", "front", "rear", "left" and "right" refer to directions with respect to an operator sitting on an operator's seat.

As shown in FIGS. 1 and 2, wheel loader 1 is self-propelled as wheels 4*a* and 4*b* are rotationally driven, and can perform desired work using work implement 3.

Wheel loader 1 includes a vehicular body frame 2, work implement 3, wheels 4*a* and 4*b*, and an operator's cab 5.

Vehicular body frame 2 has a front vehicular body portion 2*a* and a rear vehicular body portion 2*b*. Front vehicular body portion 2*a* and rear vehicular body portion 2*b* are coupled to each other so as to be swingable in a rightward/leftward direction.

A pair of steering cylinders 11*a* and 11*b* are provided to extend from front vehicular body portion 2*a* to rear vehicular body portion 2*b*. Each of steering cylinders 11*a* and 11*b* is a hydraulic cylinder driven by hydraulic oil from a steering pump 12 (see FIG. 2). Front vehicular body portion 2*a* swings with respect to rear vehicular body portion 2*b* by extension and contraction of steering cylinders 11*a* and 11*b*. As a result, a traveling direction of a vehicle is changed.

FIGS. 1 and 2 show only one of steering cylinders 11*a* and 11*b*, and do not show the other of steering cylinders 11*a* and 11*b*.

Work implement 3 and a pair of front wheels 4*a* are attached to front vehicular body portion 2*a*. Work implement 3 is driven by hydraulic oil from a work implement pump 13 (see FIG. 2). Work implement 3 has a boom 6, a pair of lift cylinders 14*a* and 14*b*, a bucket 7, a bell crank 9, and a bucket cylinder 15.

Boom 6 is rotatably supported on front vehicular body portion 2*a*. One end of each of lift cylinders 14*a* and 14*b* is attached to front vehicular body portion 2*a*. The other end of each of lift cylinders 14*a* and 14*b* is attached to boom 6. Boom 6 swings upward and downward by extension and contraction of lift cylinders 14*a* and 14*b* with the hydraulic oil from work implement pump 13.

FIGS. 1 and 2 show only one of lift cylinders 14*a* and 14*b*, and do not show the other of lift cylinders 14*a* and 14*b*.

Bucket 7 is rotatably supported on a tip end of boom 6. One end of bucket cylinder 15 is attached to front vehicular body portion 2*a*. The other end of bucket cylinder 15 is attached to bucket 7 with bell crank 9 interposed therebetween. Bucket 7 swings upward and downward by extension and contraction of bucket cylinder 15 with the hydraulic oil from work implement pump 13.

Operator's cab 5 and a pair of rear wheels 4*b* are attached to rear vehicular body portion 2*b*. Operator's cab 5 is placed on an upper part of vehicular body frame 2, and includes a seat on which an operator sits, an operation unit 8 described below, and the like.

Vehicular body frame 2 includes a fixation mechanism 19 to which a frame lock bar 18 can be attached. Frame lock bar 18 is configured to be capable of locking an articulated structure by mutually fixing front vehicular body portion 2*a* and rear vehicular body portion 2*b* to prevent swinging. Fixation mechanism 19 is configured to be capable of positioning frame lock bar 18 at a prescribed pivot position in a cantilever state.

As shown in FIG. 2, wheel loader 1 includes an engine 21 serving as a driving source, a traveling apparatus 22, work implement pump 13, steering pump 12, operation unit 8, a control unit 10 and the like.

Engine 21 is a diesel engine and an output of engine 21 is controlled by adjusting an amount of fuel to be injected into a cylinder. This adjustment is made by controlling an electronic governor 25 attached to a fuel injection pump 24 of engine 21 by control unit 10. An all-speed-control-type governor is generally used as governor 25 and governor 25 adjusts an engine rotation speed and an amount of fuel injection in accordance with a load such that the engine rotation speed becomes equal to a target rotation speed corresponding to an amount of accelerator operation described below. That is, governor 25 increases or decreases the amount of fuel injection to eliminate a difference between the target rotation speed and the actual engine rotation speed. The engine rotation speed is detected by an engine rotation speed sensor 91. A detection signal from engine rotation speed sensor 91 is input to control unit 10.

Traveling apparatus 22 is an apparatus that causes the vehicle to travel using the driving force from engine 21. Traveling apparatus 22 has a torque converter apparatus 23, a transmission 26, above-described front wheels 4*a* and rear wheels 4*b*, and the like.

Torque converter apparatus 23 has a lock-up clutch 27 and a torque converter 28. Lock-up clutch 27 can be switched between an engaged state and a disengaged state. When lock-up clutch 27 is in the disengaged state, torque converter 28 transmits the driving force from engine 21 using oil as a medium. When lock-up clutch 27 is in the engaged state, an input side and an output side of torque converter 28 are directly connected. Lock-up clutch 27 is a hydraulically-operated clutch and switching between the engaged state and the disengaged state is performed by controlling supply of the hydraulic oil to lock-up clutch 27 by control unit 10 through a clutch control valve 31.

Transmission 26 has a forward clutch CF corresponding to a forward traveling gear, and a reverse clutch CR corresponding to a rearward traveling gear. When each of clutches CF and CR is switched between an engaged state and a disengaged state, the vehicle is switched between forward traveling and rearward traveling. When clutches CF and CR are both in the disengaged state, the vehicle is in a neutral state. Transmission 26 also has a plurality of gear shifting clutches C1 to C4 corresponding to a plurality of gears, and can switch a deceleration ratio to a plurality of stages.

An output shaft of transmission 26 is provided with a T/M output rotation speed sensor 92 that detects a rotation speed of the output shaft of transmission 26. A detection signal from T/M output rotation speed sensor 92 is input to control unit 10.

Control unit 10 calculates a vehicle speed based on the detection signal from T/M output rotation speed sensor 92. Therefore, T/M output rotation speed sensor 92 functions as a vehicle speed detection unit that detects the vehicle speed. A sensor that detects a rotation speed of another portion, not the output shaft of transmission 26, may be used as a vehicle speed sensor. The driving force output from transmission 26 is transmitted to wheels 4*a* and 4*b* through a shaft 32 and the like. As a result, the vehicle travels. A rotation speed of an input shaft of transmission 26 is detected by a T/M input rotation speed sensor 93. A detection signal from T/M input rotation speed sensor 93 is input to control unit 10.

A part of the driving force from engine 21 is transmitted to work implement pump 13 and steering pump 12 through a PTO shaft 33. Each of work implement pump 13 and steering pump 12 is a hydraulic pump driven by the driving force from engine 21. The hydraulic oil discharged from work implement pump 13 is supplied to lift cylinders 14*a* and 14*b* and bucket cylinder 15 through a work implement control valve 34. In addition, the hydraulic oil discharged from steering pump 12 is supplied to steering cylinders 11*a* and 11*b* through a steering spool 35. In this way, work implement 3 is driven by a part of the driving force from engine 21.

A pressure of the hydraulic oil discharged from work implement pump 13 is detected by a first hydraulic pressure sensor 94. A pressure of the hydraulic oil supplied to lift cylinders 14*a* and 14*b* is detected by a second hydraulic pressure sensor 95. Specifically, second hydraulic pressure sensor 95 detects a hydraulic pressure in a cylinder bottom chamber to which the hydraulic oil is supplied when lift cylinders 14*a* and 14*b* are extended. A pressure of the hydraulic oil supplied to bucket cylinder 15 is detected by a third hydraulic pressure sensor 96. Specifically, third hydraulic pressure sensor 96 detects a hydraulic pressure in the cylinder bottom chamber to which the hydraulic oil is supplied when bucket cylinder 15 is extended. A pressure of the hydraulic oil discharged from steering pump 12 is detected by a fourth hydraulic pressure sensor 97. Detection signals from first to fourth hydraulic pressure sensors 94 to 97 are input to control unit 10.

Operation unit 8 is operated by the operator. Operation unit 8 has an accelerator operation member 81*a*, an accelerator operation detection device 81*b*, a steering operation member 82*a*, a steering operation detection device 82*b*, a boom operation member 83*a*, a boom operation detection device 83*b*, a bucket operation member 84*a*, a bucket operation detection device 84*b*, a gear-shifting operation member 85*a*, a gear-shifting operation detection device 85*b*, an FR operation member 86*a*, an FR operation detection device 86*b* and the like.

Accelerator operation member 81*a* is, for example, an accelerator pedal and is operated to set the target rotation speed of engine 21. Accelerator operation detection device 81*b* detects an amount of operation of accelerator operation member 81*a*. Accelerator operation detection device 81*b* outputs a detection signal to control unit 10.

Steering operation member 82*a* is, for example, a steering lever and is operated to control the traveling direction of the vehicle. Steering operation detection device 82*b* detects a position of steering operation member 82*a* and outputs a detection signal to control unit 10. Control unit 10 controls steering spool 35 based on the detection signal from steering operation detection device 82*b*. This causes extension and contraction of steering cylinders 11*a* and 11*b*, and the traveling direction of the vehicle is changed.

An articulation angle detection sensor 99 detects an articulation angle from a neutral position to the right and left when the traveling direction of the vehicle is changed, and outputs a detection signal to control unit 10. The neutral position is a position at which front vehicular body portion 2*a* and rear vehicular body portion 2*b* are aligned on a straight line.

Each of boom operation member 83*a* and bucket operation member 84*a* is, for example, a control lever and is operated to operate work implement 3. Specifically, boom operation member 83*a* is operated to operate boom 6. Bucket operation member 84*a* is operated to operate bucket 7. Boom operation detection device 83*b* detects a position of boom operation member 83*a*. Bucket operation detection device 84*b* detects a position of bucket operation member 84*a*. Boom operation detection device 83*b* and bucket operation detection device 84*b* output detection signals to control unit 10. Control unit 10 controls work implement control valve 34 based on the detection signals from boom operation detection device 83*b* and bucket operation detection device 84*b*. This causes extension and contraction of lift cylinders 14*a* and 14*b* and bucket cylinder 15, and boom 6 and bucket 7 operate. Work implement 3 is also provided with a boom angle detection device 98 that detects a boom angle. The boom angle refers to an angle formed by a line that connects a rotation support center of front vehicular body portion 2*a* and boom 6 and a rotation support center of boom 6 and bucket 7 and a line that connects shaft centers of front wheels 4*a* and rear wheels 4*b*. Boom angle detection device 98 outputs a detection signal to control unit 10.

Control unit 10 calculates a height position of bucket 7 based on the boom angle detected by boom angle detection device 98. Therefore, boom angle detection device 98 functions as a height position detection unit that detects a height of bucket 7.

Gear-shifting operation member 85*a* is, for example, a shift lever. Gear-shifting operation detection device 85*b* detects a position of gear-shifting operation member 85*a*. Gear-shifting operation detection device 85*b* outputs a detection signal to control unit 10. Control unit 10 controls gear shifting of transmission 26 based on the detection signal from gear-shifting operation detection device 85*b*.

FR operation member 86*a* is operated to switch the vehicle between forward traveling and rearward traveling. FR operation member 86*a* can be switched to each of a forward traveling position, a neutral position and a rearward traveling position. FR operation detection device 86*b* detects a position of FR operation member 86*a*. FR operation detection device 86*b* outputs a detection signal to control unit 10. Control unit 10 controls clutch control valve 31 based on the detection signal from FR operation detection device 86*b*. This causes control of forward clutch CF and reverse clutch CR, and the vehicle is switched among forward traveling, rearward traveling and the neutral state.

Control unit 10 is generally implemented by reading various programs by a central processing unit (CPU).

Control unit 10 is connected to a memory 60. Memory 60 functions as a work memory, and various programs for performing the functions of the wheel loader are stored in memory 60.

Control unit 10 sends an engine command signal to governor 25 such that the target rotation speed corresponding to the amount of accelerator operation is obtained.

Control unit 10 is also connected to a display 50. Display 50 can show an operation guidance to the operator, which will be described below. In addition, display 50 is provided with an input device such as a touch panel, and by operating the touch panel, a command can be provided to control unit 10.

Control unit 10 has a calibration mode of performing calibration of a command current that is output when steering cylinders 11*a* and 11*b* are driven in accordance with the operation of steering operation member 82*a*.

Display 50 shows a screen for executing the calibration mode of performing calibration of the command current that is output when steering cylinders 11*a* and 11*b* are driven in accordance with the operation of steering operation member 82*a*. When the operator operates the touch panel on the screen for executing the calibration mode, a command to execute the calibration mode is provided to control unit 10.

Steering cylinders 11*a* and 11*b*, steering operation member 82*a* and steering operation detection device 82*b*, steering spool 35, and control unit 10 are examples of "hydraulic cylinder for steering", "operation apparatus", "steering spool", and "controller" in the present disclosure, respectively.

<Configuration of Steering System>

Figure 3:
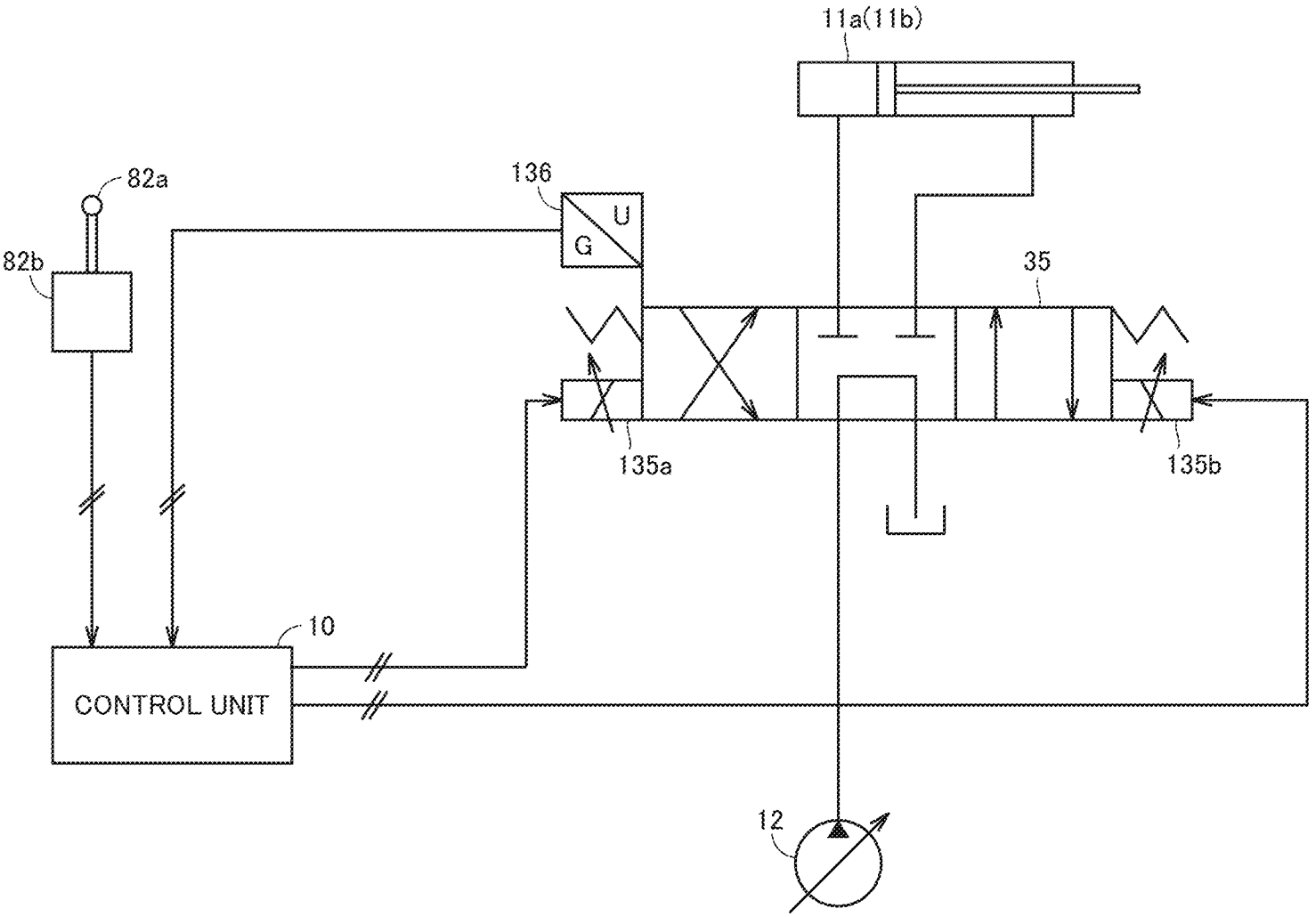
FIG. 3 is a schematic block diagram showing a configuration of a steering system of wheel loader 1 based on the first embodiment.

FIG. 3 is a schematic block diagram showing a configuration of a steering system of wheel loader 1 based on the first embodiment.

As shown in FIG. 3, the steering system of wheel loader 1 includes steering cylinder 11*a* (11*b*), steering operation member 82*a*, steering operation detection device 82*b*, steering spool 35, solenoid control valves 135*a* and 135*b*, a spool position sensor 136, steering pump 12, and control unit 10.

Steering operation detection device 82*b* detects the position of steering operation member 82*a* and outputs the detection signal to control unit 10. Control unit 10 outputs a command current to solenoid control valve 135*a* (135*b*) based on the detection signal from steering operation detection device 82*b*. Solenoid control valve 135*a* (135*b*) adjusts an amount of supply of the hydraulic oil to be supplied from steering pump 12 to steering cylinder 11*a* (11*b*) through steering spool 35 in accordance with the command current from control unit 10. Specifically, the amount of supply of the hydraulic oil to be supplied to steering cylinder 11*a* (11*b*) is adjusted by adjusting a spool position in steering spool 35. This causes extension and contraction of steering cylinder 11*a* (11*b*), and the traveling direction of the vehicle is changed.

Spool position sensor 136 is a sensor that detects the spool position in steering spool 35, and outputs the spool position to control unit 10.

In order to make fine adjustment of the traveling direction of the vehicle, fine operability is required for the steering system. The use of a region where an opening area of steering spool 35 is extremely small is necessary. However, there is a variation in properties of solenoid control valve 135*a* (135*b*), and thus, there is also a variation in a command current that causes steering spool 35 to start opening (opening start current).

Even when the operator makes an input for fine operation of steering operation member 82*a* (an input that expects a low steering speed), the steering speed may become higher than the intended speed if steering spool 35 is widely opened, and thus, fine adjustment of the traveling direction of the vehicle cannot in some cases be made.

Therefore, it is necessary to execute the calibration mode of performing calibration of the command current that is output when steering cylinder 11*a* (11*b*) is driven in accordance with the operation of steering operation member 82*a*. Since steering is performed both in the left direction and in the right direction, it is necessary to execute the calibration mode for each of the left direction and the right direction. In the present example, execution of the calibration mode for only one direction (e.g., the right direction) is described.

Solenoid control valve 135*a* (135*b*) is an example of "control valve" in the present disclosure.

Figure 4:
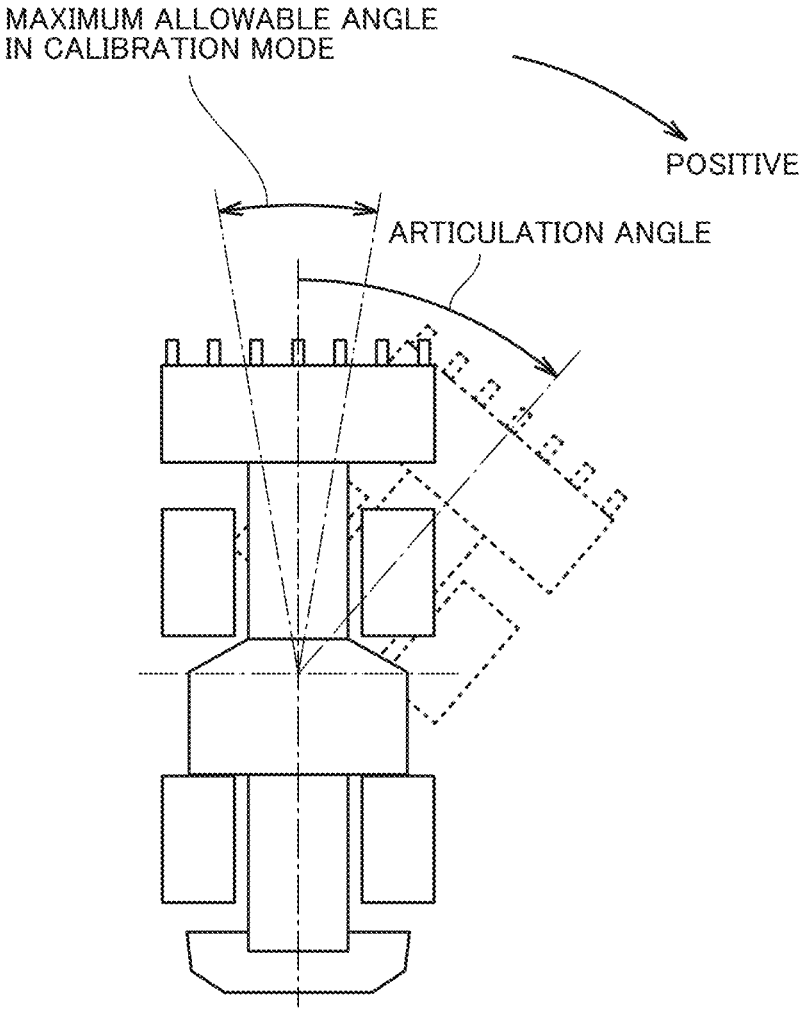
FIG. 4 is a diagram illustrating a state of wheel loader 1 in a calibration mode based on the first embodiment.

FIG. 4 is a diagram illustrating a state of wheel loader 1 in the calibration mode based on the first embodiment.

Referring to FIG. 4, when steering cylinders 11*a* and 11*b* extend and contract, the traveling direction of wheel loader 1 changes from the neutral position at which front vehicular body portion 2*a* and rear vehicular body portion 2*b* are aligned on the straight line. As an example, the case in which the traveling direction changes to the right side is shown as "positive".

In the calibration mode based on the present embodiment, steering spool 35 is supplied with the maximum opening current, which increases in accordance with the sweep current, from the opening start current of steering spool 35 to the maximum opening current, and the hydraulic oil is supplied to steering cylinder 11*a* (11*b*). Steering cylinder 11*a* (11*b*) changes the traveling direction of the vehicle in accordance with an amount of supply of the hydraulic oil.

The case in which frame lock bar 18 is attached to fixation mechanism 19 in the calibration mode will be considered. Frame lock bar 18 is configured to be capable of locking the articulated structure by mutually fixing front vehicular body portion 2*a* and rear vehicular body portion 2*b* to prevent swinging. As a result, in the calibration mode, the articulation angle falls within a prescribed range.

In the first embodiment, the case of setting a maximum allowable angle in the calibration mode, and continuing the calibration mode when the articulation angle is within the range of the maximum allowable angle and ending the calibration mode when the articulation angle exceeds the maximum allowable angle is described.

<Process in Calibration Mode>

Figure 5:
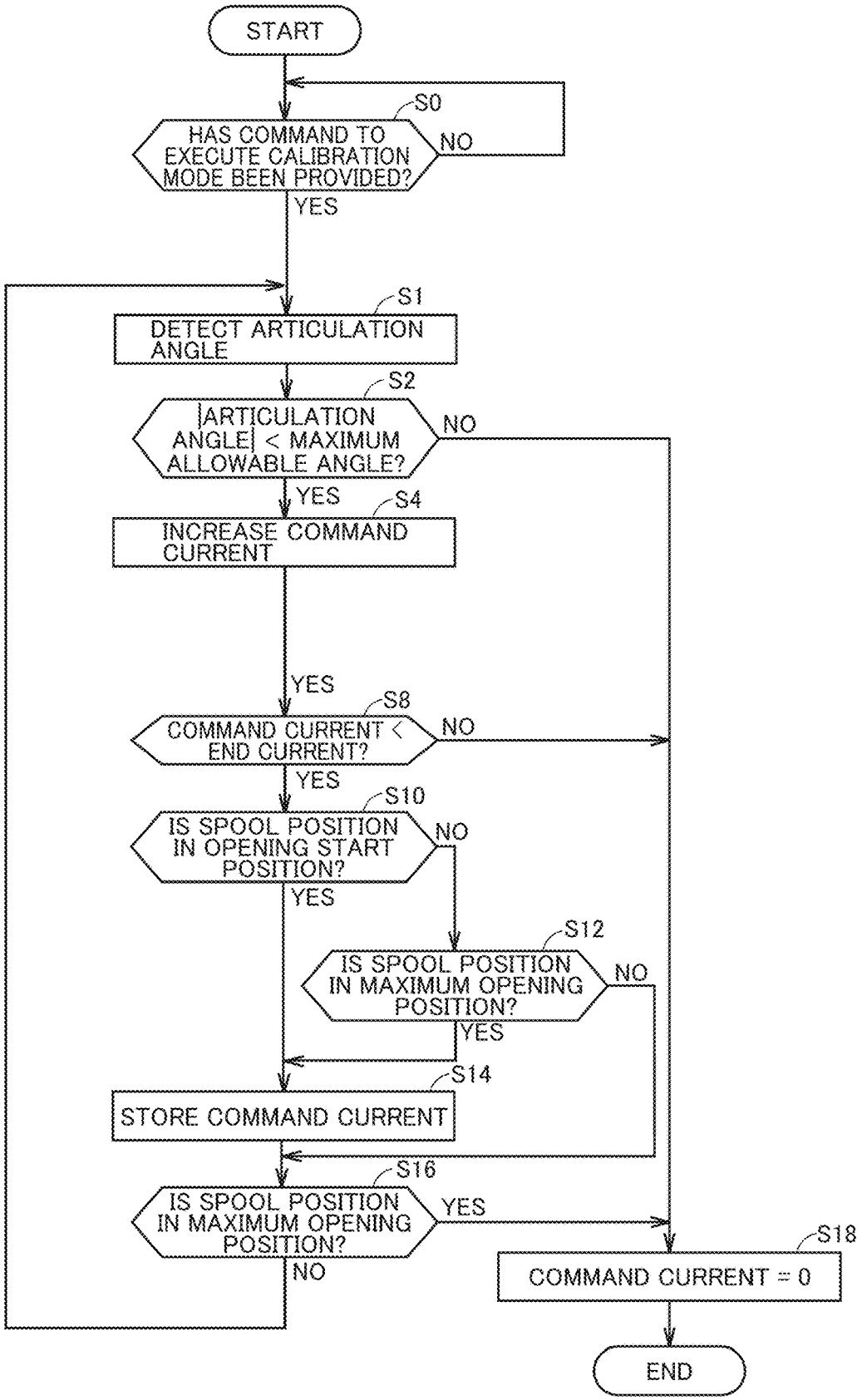
FIG. 5 is a flowchart illustrating a process in a calibration mode of the steering system of wheel loader 1 based on the first embodiment.

FIG. 5 is a flowchart illustrating a process in the calibration mode of the steering system of wheel loader 1 based on the first embodiment.

Referring to FIG. 5, control unit 10 determines whether the command to execute the calibration mode has been provided (step S0). The screen for executing the calibration mode is shown on display 50 based on the embodiment and when the operator operates the touch panel, the command to execute the calibration mode is provided to control unit 10.

When control unit 10 determines in step S0 that the command to execute the calibration mode has been provided (YES in step S0), control unit 10 detects the articulation angle (step S1). Control unit 10 receives a detection signal from articulation angle detection sensor 99 and detects the articulation angle.

Next, control unit 10 determines whether the articulation angle is within the range of the maximum allowable angle (step S2).

When control unit 10 determines in step S2 that the articulation angle is not within the range of the maximum allowable angle (NO in step S2), control unit 10 sets the command current to zero (step S18). Then, control unit 10 ends the process in the calibration mode (END).

On the other hand, when control unit 10 determines in step S2 that the articulation angle is within the range of the maximum allowable angle (YES in step S2), control unit 10 increases the command current (step S4).

Figure 6:
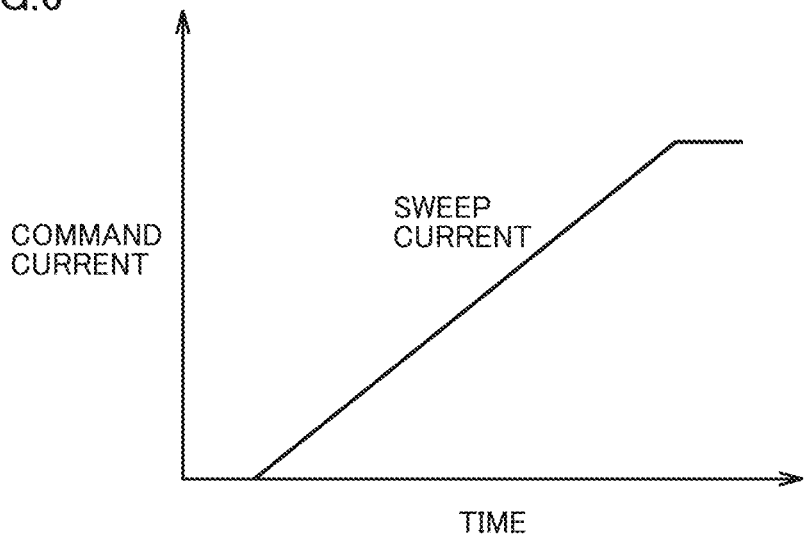
FIG. 6 is a diagram illustrating an increase in a command current based on the first embodiment.

FIG. 6 is a diagram illustrating the increase in the command current based on the first embodiment.

Referring to FIG. 6, the command current based on the first embodiment is set as a sweep current and rises at a constant rate of increase with the passage of time.

Referring again to FIG. 5, control unit 10 determines whether the command current is smaller than an end current (step S8).

When control unit 10 determines in step S8 that the command current is smaller than the end current (YES in step S8), control unit 10 determines whether the spool position is in an opening start position (step S10). Spool position sensor 136 outputs the spool position to control unit 10. The spool position that is in the opening start position of steering spool 35 is preset. Based on a detection result of the spool position from spool position sensor 136, control unit 10 determines whether the spool position is in the opening start position.

When control unit 10 determines in step S10 that the spool position is in the opening start position (YES in step S10), control unit 10 stores the command current in this position (step S14).

On the other hand, when control unit 10 determines in step S10 that the spool position is not in the opening start position (NO in step S10), control unit 10 determines whether the spool position is in a maximum opening position (step S12). Spool position sensor 136 outputs the spool position to control unit 10. The spool position that is in the maximum opening position of steering spool 35 is preset. Based on a detection result of the spool position from spool position sensor 136, control unit 10 determines whether the spool position is in the maximum opening position.

When control unit 10 determines in step S12 that the spool position is in the maximum opening position (YES in step S12), control unit 10 stores the command current in this position (step S14).

On the other hand, when control unit 10 determines in step S12 that the spool position is not in the maximum opening position (NO in step S12), step S14 is skipped and the process proceeds to step S16.

In step S16, control unit 10 determines whether the spool position is beyond the maximum opening position.

When control unit 10 determines in step S16 that the spool position is not beyond the maximum opening position (NO in step S16), the process returns to step S1 and control unit 10 detects the articulation angle. The subsequent processing is the same.

On the other hand, when control unit 10 determines in step S16 that the spool position is beyond the maximum opening position (YES in step S16), control unit 10 sets the command current to zero (step S18). Then, control unit 10 ends the process in the calibration mode (END).

On the other hand, when control unit 10 determines in step S8 that the command current is larger than the end current (NO in step S8), control unit 10 sets the command current to zero (step S18). Then, control unit 10 ends the process in the calibration mode (END). A value of the end current is a value of a current flowing when an abnormality occurs in a current system. Since there is an abnormality when the command current is larger than the end current, the process in the calibration mode is ended, which makes it possible to end the process in the calibration mode without affecting the surroundings of the work machine.

With this process, when control unit 10 determines that the command to execute the calibration mode has been provided, control unit 10 detects the articulation angle, and continues the calibration mode when the detected articulation angle is within the range of the maximum allowable angle and ends the process in the calibration mode when the detected articulation angle is not within the range of the maximum allowable angle.

At the time of the calibration process for the work machine having the steering system, the steering spool operates automatically in accordance with the increase in the command current, and thus, steering operates automatically. In the case of a work machine such as an articulated wheel loader, when steering operates automatically, the work machine may interfere with a surrounding object depending on the situation.

In the scheme based on the first embodiment, it is possible to execute the calibration mode while always monitoring whether the articulation angle is within the range of the maximum allowable angle. Therefore, interference of the work machine can be avoided, which enables execution of the calibration mode without affecting the surroundings of the work machine.

Figure 7:
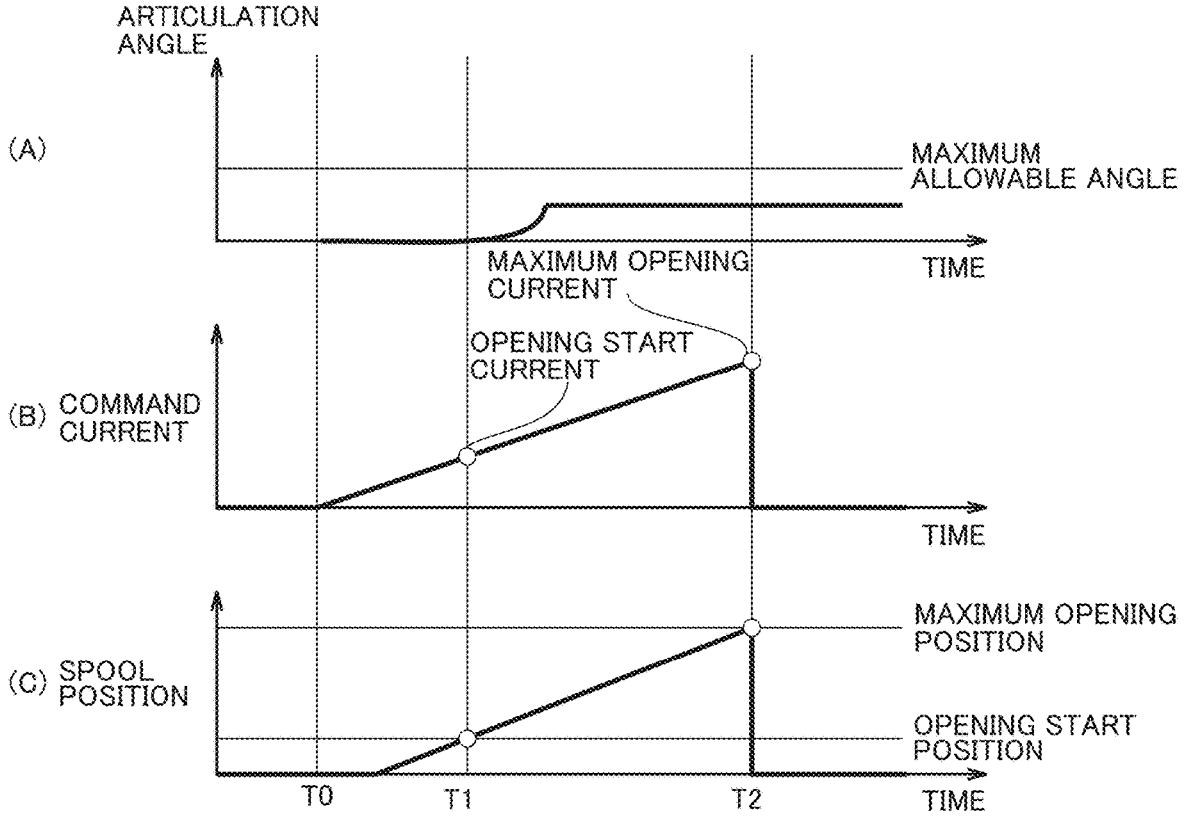
FIG. 7 is a diagram illustrating a timing chart (No. 1) in the calibration mode of the steering system of wheel loader 1 based on the first embodiment.

FIG. 7 is a diagram illustrating a timing chart (No. 1) in the calibration mode of the steering system of wheel loader 1 based on the first embodiment.

FIG. 7(A) shows the articulation angle that changes with the passage of time.

FIG. 7(B) shows the command current that changes with the passage of time.

FIG. 7(C) shows the spool position that changes with the passage of time.

At time T0, the command current that is the sweep current described with reference to FIG. 6 starts to increase.

At time T1, the spool position reaches the opening start position. This causes steering cylinders 11*a* and 11*b* to extend and contract, and wheel loader 1 operates such that the traveling direction changes from the neutral position at which front vehicular body portion 2*a* and rear vehicular body portion 2*b* are aligned on the straight line. On the other hand, when frame lock bar 18 is attached to fixation mechanism 19, front vehicular body portion 2*a* and rear vehicular body portion 2*b* are mutually fixed to prevent swinging, and thus, the articulation angle falls within the prescribed range. Cylinder pressures in steering cylinders 11*a* and 11*b* are relieved through a not-shown relief valve.

Control unit 10 stores the command current in the opening start position (opening start current).

At time T2, the spool position reaches the maximum opening position.

Control unit 10 stores the command current in the maximum opening position (maximum opening current).

Control unit 10 determines that the spool position has gone beyond the maximum opening position, and thus, control unit 10 sets the command current to zero and ends the calibration mode.

Figure 8:
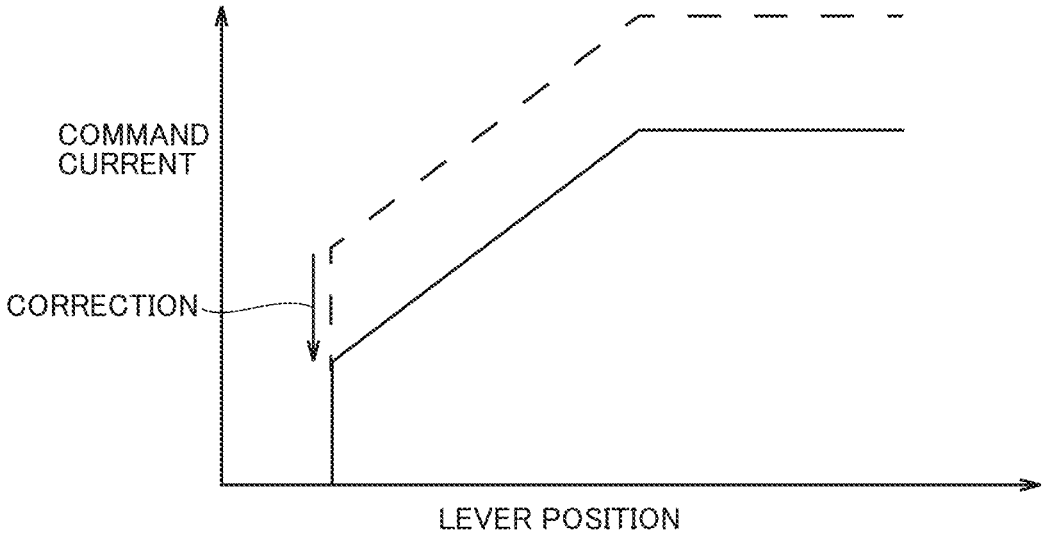
FIG. 8 is a diagram illustrating a specific example of a process of calibrating the command current in the calibration mode of the steering system of wheel loader 1 based on the first embodiment.

FIG. 8 is a diagram illustrating a specific example of the process of calibrating the command current in the calibration mode of the steering system of wheel loader 1 based on the first embodiment.

Referring to FIG. 8, FIG. 8 shows the case of correcting the command current with respect to the lever position of steering operation member 82*a* based on the opening start current and the maximum opening current stored in the calibration mode. In the present example, the case of performing the calibration process of decreasing the command current with respect to the lever position of steering operation member 82*a* to attain an intended steering speed is described.

As the calibration mode, the opening start current and the maximum opening current are measured, whereby a rate of increase in the command current with respect to the lever position of steering operation member 82*a* can also be adjusted.

Figure 9:
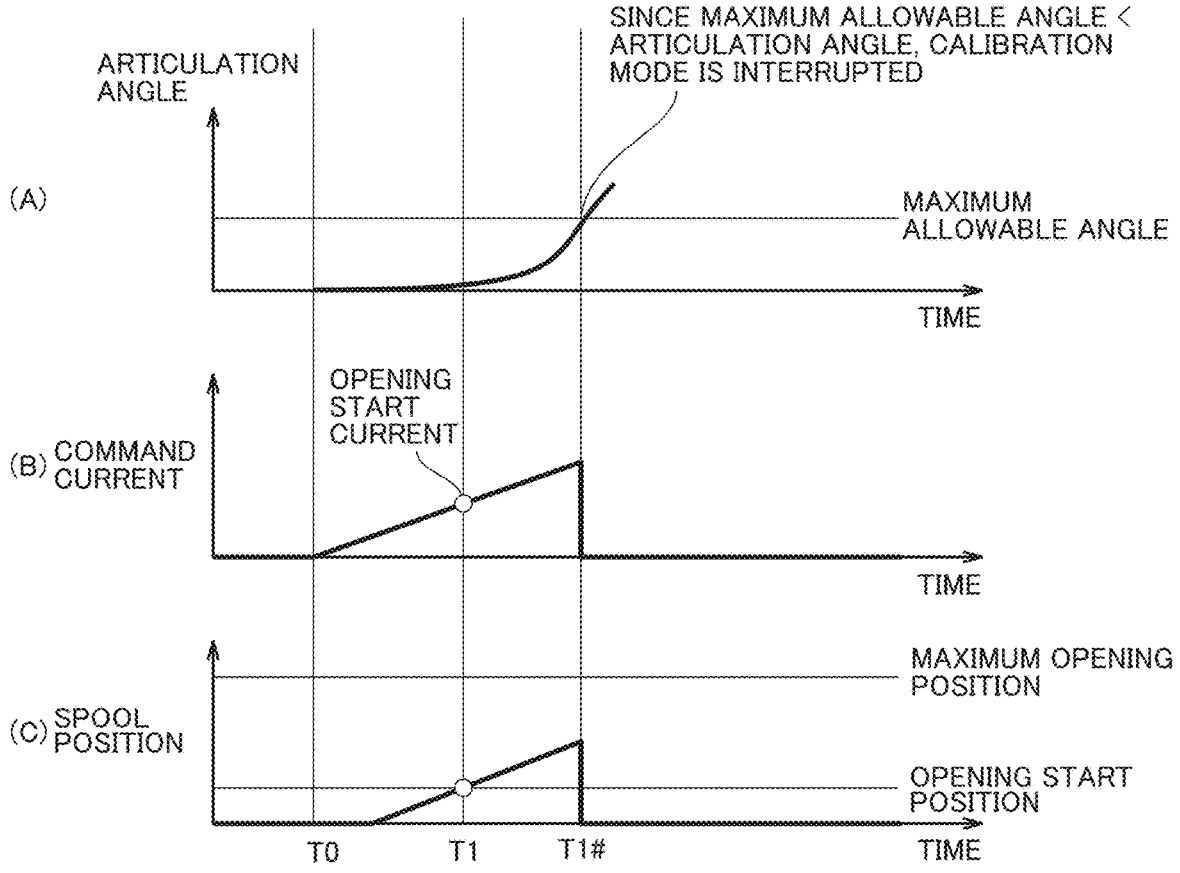
FIG. 9 is a diagram illustrating a timing chart (No. 2) in the calibration mode of the steering system of wheel loader 1 based on the first embodiment.

FIG. 9 is a diagram illustrating a timing chart (No. 2) in the calibration mode of the steering system of wheel loader 1 based on the first embodiment.

FIG. 9(A) shows the articulation angle that changes with the passage of time.

FIG. 9(B) shows the command current that changes with the passage of time.

FIG. 9(C) shows the spool position that changes with the passage of time.

At time T0, the command current that is the sweep current described with reference to FIG. 6 starts to increase.

At time T1, the spool position reaches the opening start position. This causes steering cylinders 11*a* and 11*b* to extend and contract, and wheel loader 1 operates such that the traveling direction changes from the neutral position at which front vehicular body portion 2*a* and rear vehicular body portion 2*b* are aligned on the straight line. If frame lock bar 18 is not attached to fixation mechanism 19, the articulation angle continues to increase.

Control unit 10 stores the command current in the opening start position (opening start current).

At time T1#, the articulation angle exceeds the maximum allowable angle.

Control unit 10 sets the command current to zero and ends the calibration mode.

With this process, when the calibration mode is executed in a state where frame lock bar 18 is not attached to fixation mechanism 19, for example, the articulation angle continues to increase and exceeds the maximum allowable angle, and thus, the command current becomes zero and the calibration mode is immediately stopped.

In the case of the scheme based on the first embodiment, the calibration mode is executed while the articulation angle is always monitored. Therefore, interference of the work machine can be avoided, which enables execution of the calibration mode without affecting the surroundings of the work machine.

Second Embodiment

The case in which the sweep current is used as the increasing command current in the calibration mode has been described in the first embodiment.

A scheme in which the sweep current is not used in the calibration mode will be described in a second embodiment.

Figure 10:
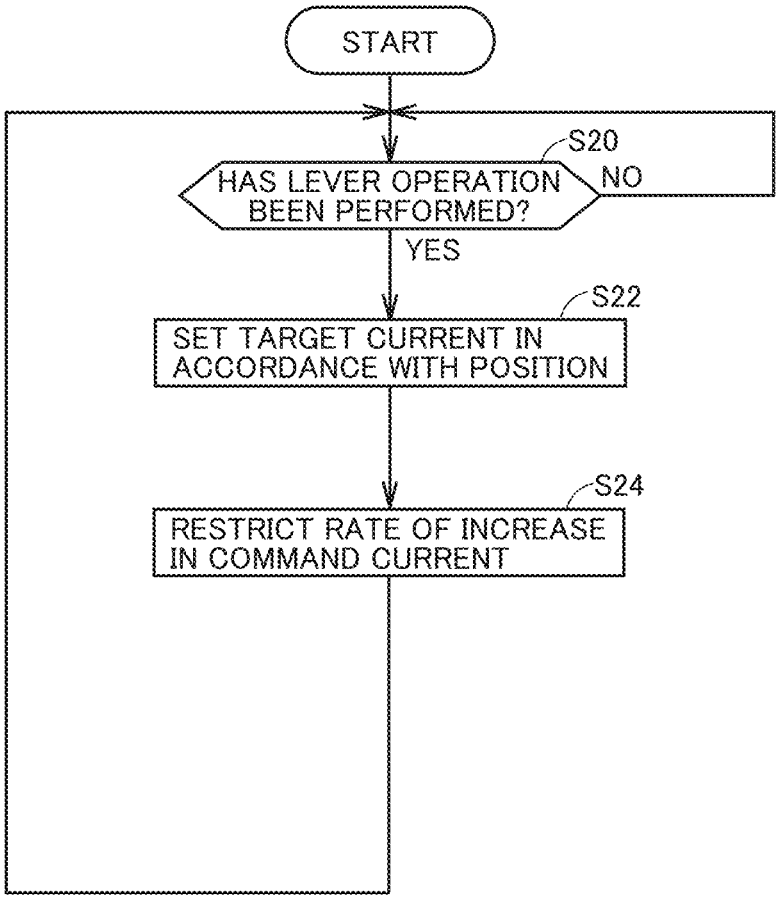
FIG. 10 is a flowchart illustrating setting of a command current with respect to a lever position of a steering operation member 82*a* based on a second embodiment.

FIG. 10 is a flowchart illustrating setting of the command current with respect to the lever position of steering operation member 82*a* based on the second embodiment.

Referring to FIG. 10, control unit 10 determines whether a lever operation on steering operation member 82*a* has been performed (step S20).

Control unit 10 sets a target current in accordance with a position of the lever operation on steering operation member 82*a* (step S22).

Next, control unit 10 restricts a rate of increase in the command current with respect to the set target current (step S24).

Then, the process returns to step S20 and control unit 10 continues the above-described process.

Figure 11:
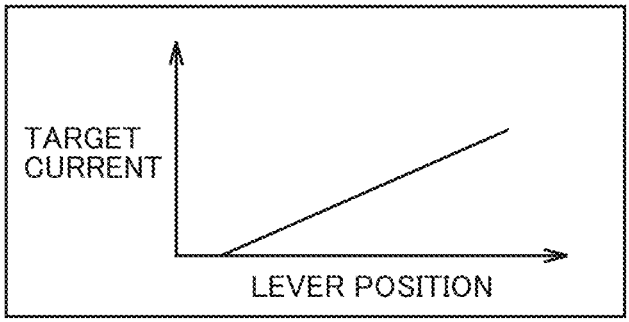
FIG. 11 is a diagram illustrating a setting table for setting a target current with respect to the lever position of steering operation member 82*a* based on the second embodiment.
Figure 11:
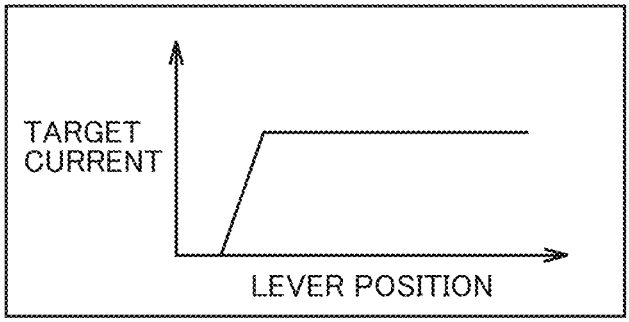

FIG. 11 is a diagram illustrating a setting table for setting the target current with respect to the lever position of steering operation member 82*a* based on the second embodiment.

Referring to FIG. 11(A), FIG. 11(A) shows a setting table in a normal operation. FIG. 11(A) shows a case in which the target current increases linearly with respect to the lever position of steering operation member 82*a*.

In the present example, control unit 10 restricts the rate of increase in the command current when control unit 10 outputs the command current such that the command current becomes equal to the set target current. That is, the command current increases at a constant rate of increase with the passage of time such that the command current becomes equal to the set target current. Thus, a sudden increase or decrease in the current can be avoided and smooth steering control can be achieved.

Referring to FIG. 11(B), FIG. 11(B) shows a setting table in the calibration mode based on the second embodiment.

The target current is immediately set to a prescribed value with respect to the lever position of steering operation member 82*a*. Therefore, the target current can be easily set to the prescribed value by moving the lever position beyond the prescribed position in the calibration mode, and thus, the operator does not need to always pay attention to the lever position and the operation becomes easier. In the first embodiment, the command current automatically increases at the constant rate of increase with the passage of time regardless of the lever position. However, in the second embodiment, the target current is set in accordance with the lever position and the command current is output such that the command current becomes equal to the set target current.

Control unit 10 restricts the rate of increase in the command current when control unit 10 outputs the command current such that the command current becomes equal to the set target current. That is, the command current increases at the constant rate of increase with the passage of time such that the command current becomes equal to the set target current.

The rate of increase in the command current in the normal operation and the rate of increase in the command current in the calibration mode may be adjusted. For example, the rate of increase in the command current in the calibration mode may be adjusted to the rate of increase in the sweep current described with reference to FIG. 6.

Figure 12:
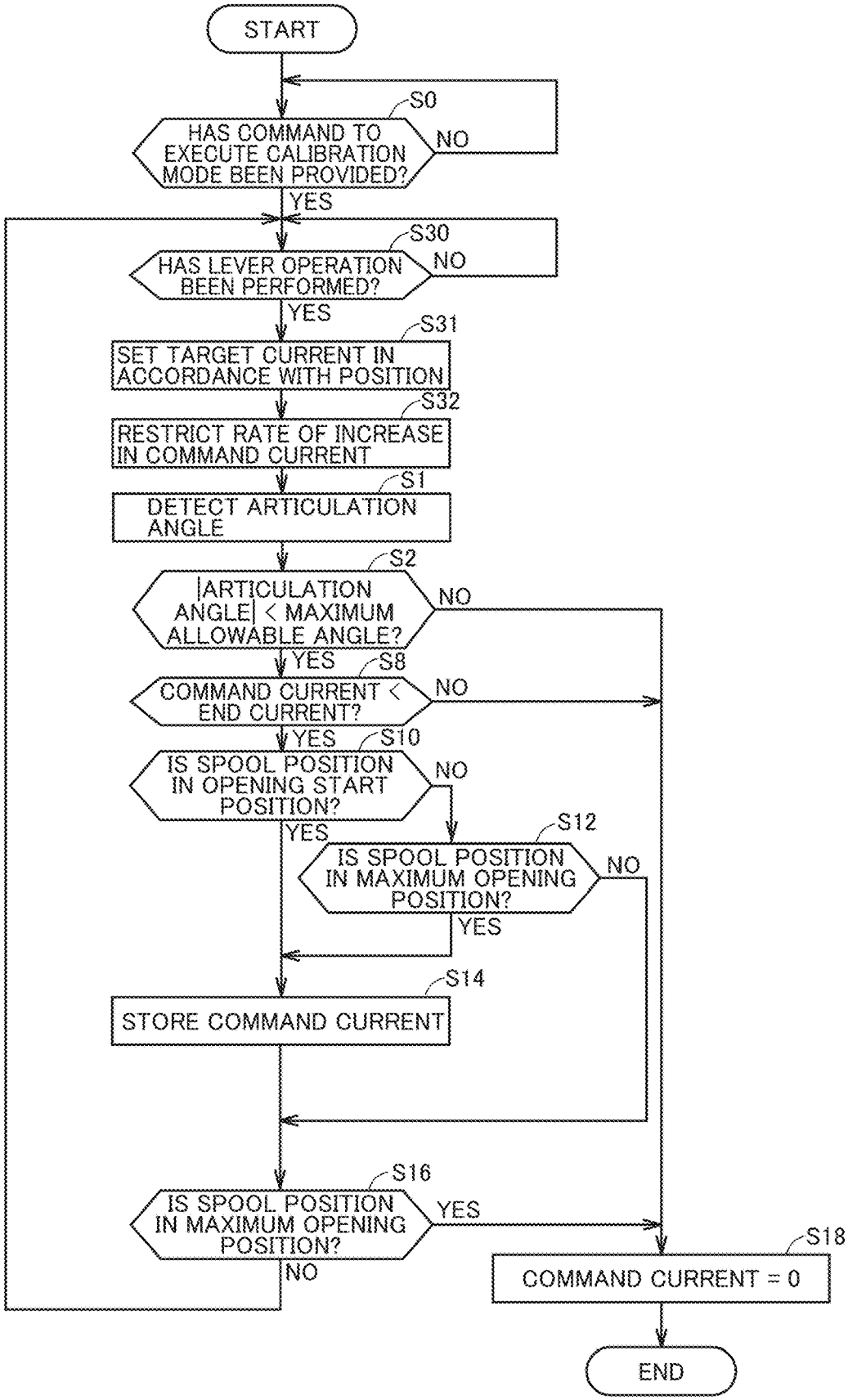
FIG. 12 is a flowchart illustrating a process in a calibration mode of a steering system of wheel loader 1 based on the second embodiment.

FIG. 12 is a flowchart illustrating a process in the calibration mode of the steering system of wheel loader 1 based on the second embodiment.

Referring to FIG. 12, the flowchart in FIG. 12 is different from the flowchart in FIG. 5 in that steps S30 to S32 are added. Since the remaining flow is the same, detailed description thereof will not be repeated.

Control unit 10 determines whether the command to execute the calibration mode has been provided (step S0). The screen for executing the calibration mode is shown on display 50 based on the embodiment and when the operator operates the touch panel, the command to execute the calibration mode is provided to control unit 10.

When control unit 10 determines in step S0 that the command to execute the calibration mode has not been provided (NO in step S0), control unit 10 maintains the state in step S0.

When control unit 10 determines in step S0 that the command to execute the calibration mode has been provided (YES in step S0), control unit 10 next determines whether the lever operation has been performed (step S30).

When control unit 10 determines in step S30 that the lever operation on steering operation member 82*a* has not been performed (NO in step S30), control unit 10 maintains the state in step S30.

When control unit 10 determines in step S30 that the lever operation on steering operation member 82*a* has been performed (YES in step S30), control unit 10 sets the target current in accordance with the lever position (step S31). Specifically, the target current is set using the setting table described with reference to FIG. 11(B). The target current is immediately set to the prescribed value in response to the change in the lever position.

Next, control unit 10 restricts the rate of increase in the command current when control unit 10 outputs the command current such that the command current becomes equal to the set target current (step S32). That is, the command current increases at a constant rate of increase with the passage of time such that the command current becomes equal to the set target current.

Next, control unit 10 detects the articulation angle (step S1). Control unit 10 receives a detection signal from articulation angle detection sensor 99 and detects the articulation angle.

Next, control unit 10 determines whether the articulation angle is within the range of the maximum allowable angle (step S2).

When control unit 10 determines in step S2 that the articulation angle is not within the range of the maximum allowable angle (NO in step S2), control unit 10 sets the command current to zero (step S18). Then, control unit 10 ends the process in the calibration mode (END).

On the other hand, when control unit 10 determines in step S2 that the articulation angle is within the range of the maximum allowable angle (YES in step S2), control unit 10 determines whether the command current is smaller than the end current (step S8).

Since the subsequent processing is the same as that described with reference to FIG. 6, detailed description thereof will not be repeated.

When control unit 10 determines in step S16 that the spool position is not beyond the maximum opening position (NO in step S16), the process returns to step S30 and control unit 10 repeats the above-described processing.

With this process, when control unit 10 determines that the command to execute the calibration mode has been provided and when the operation on the lever position of steering operation member 82*a* by the operator has been performed, control unit 10 increases the command current with respect to the set target current. In addition, control unit 10 restricts the rate of increase in the command current, whereby control unit 10 can output the sweep current described with reference to FIG. 6 as an example.

In the calibration mode, control unit 10 detects the articulation angle, and continues the calibration mode when the detected articulation angle is within the range of the maximum allowable angle and ends the process in the calibration mode when the detected articulation angle is not within the range of the maximum allowable angle.

In the case of the scheme based on the second embodiment, it is possible to execute the calibration mode while always monitoring whether the articulation angle is within the range of the maximum allowable angle. Therefore, interference of the work machine can be avoided, which enables execution of the calibration mode without affecting the surroundings of the work machine.

Figure 13:
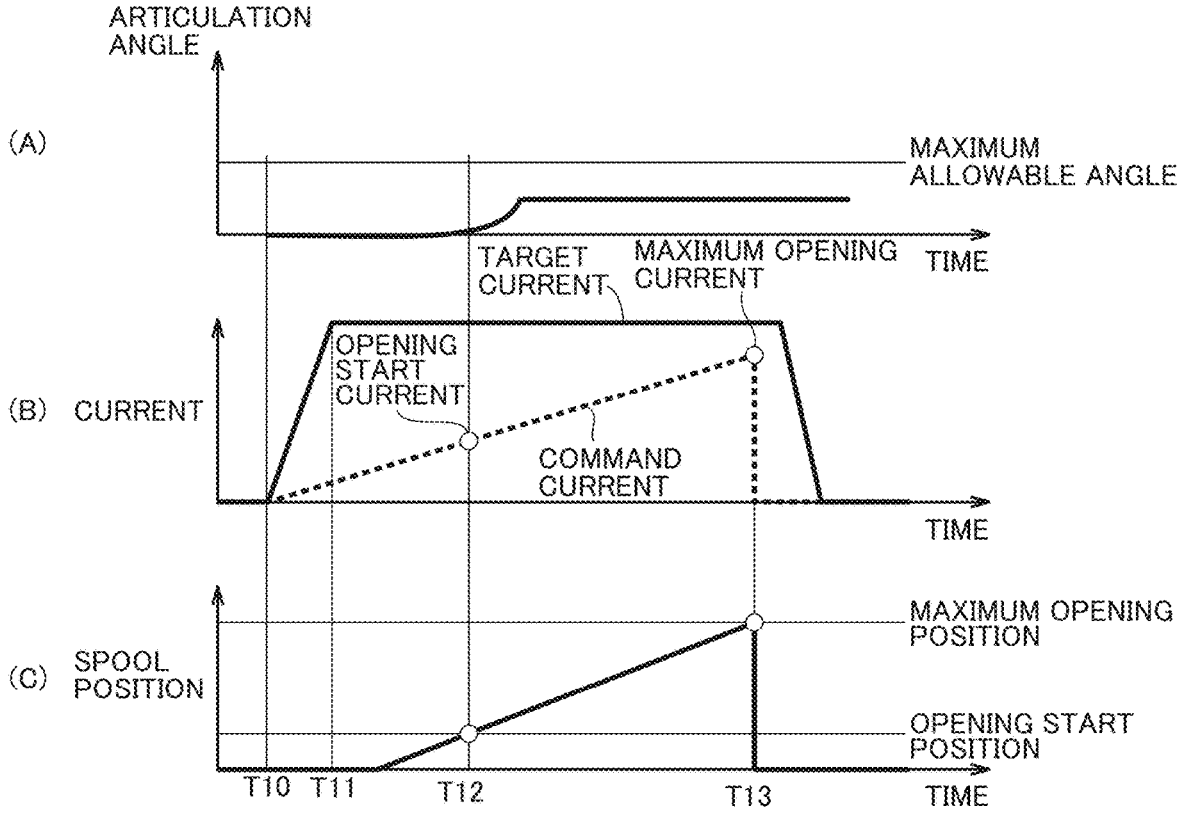
FIG. 13 is a diagram illustrating a timing chart (No. 1) in the calibration mode of the steering system of wheel loader 1 based on the second embodiment.

FIG. 13 is a diagram illustrating a timing chart (No. 1) in the calibration mode of the steering system of wheel loader 1 based on the second embodiment.

FIG. 13(A) shows the articulation angle that changes with the passage of time.

FIG. 13(B) shows the command current that changes with the passage of time.

FIG. 13(C) shows the spool position that changes with the passage of time.

At time T10, the command current starts to increase in response to the start of the operation on the lever position of steering operation member 82*a*.

At time T11, the target current is set to the prescribed value. In accordance with restriction of the rate of increase, the command current increases at the constant rate of increase such that the command current becomes equal to the target current.

At time T12, the spool position reaches the opening start position. This causes steering cylinders 11*a* and 11*b* to extend and contract, and wheel loader 1 operates such that the traveling direction changes from the neutral position at which front vehicular body portion 2*a* and rear vehicular body portion 2*b* are aligned on the straight line. On the other hand, when frame lock bar 18 is attached to fixation mechanism 19, front vehicular body portion 2*a* and rear vehicular body portion 2*b* are mutually fixed to prevent swinging, and thus, the articulation angle falls within the prescribed range. Cylinder pressures in steering cylinders 11*a* and 11*b* are relieved through a not-shown relief valve.

Control unit 10 stores the command current in the opening start position (opening start current).

At time T13, the spool position reaches the maximum opening position.

Control unit 10 stores the command current in the maximum opening position (maximum opening current).

Control unit 10 determines that the spool position has gone beyond the maximum opening position, and thus, control unit 10 sets the command current to zero and ends the calibration mode.

Figure 14:
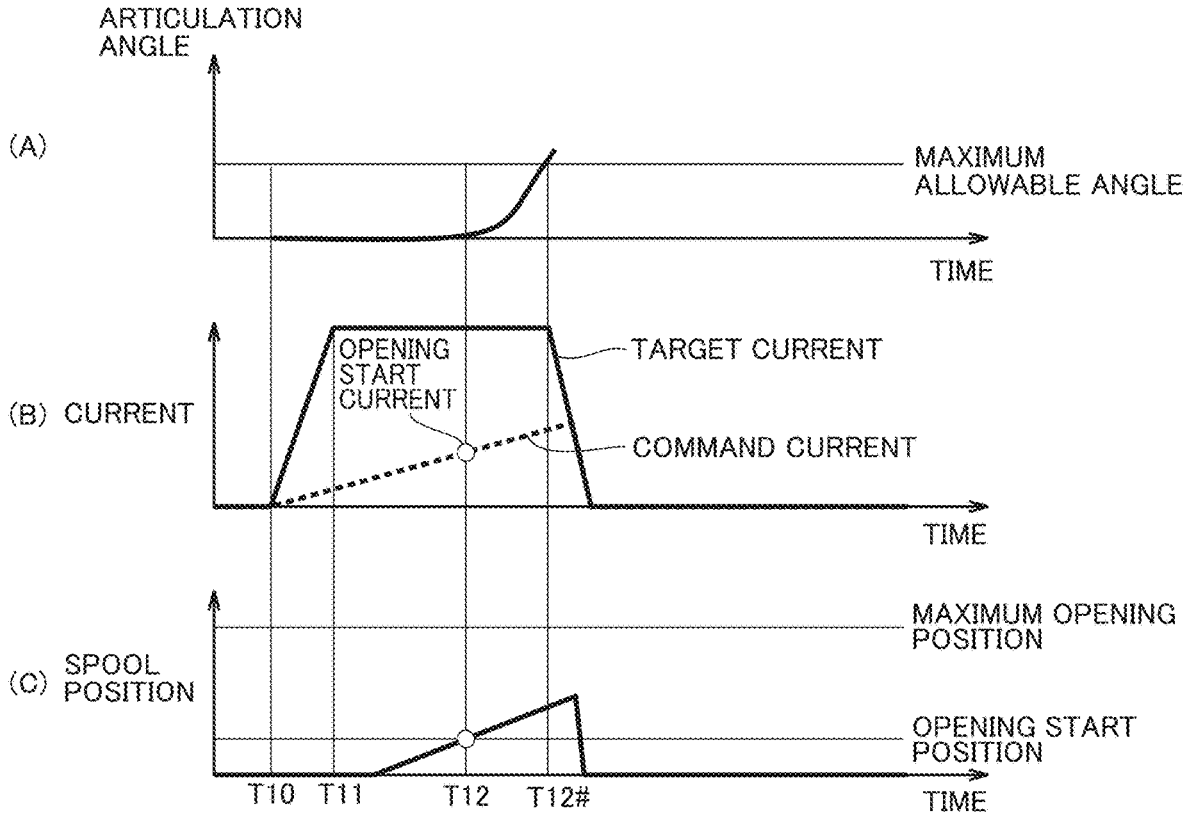
FIG. 14 is a diagram illustrating a timing chart (No. 2) in the calibration mode of the steering system of wheel loader 1 based on the second embodiment.

FIG. 14 is a diagram illustrating a timing chart (No. 2) in the calibration mode of the steering system of wheel loader 1 based on the second embodiment.

FIG. 14(A) shows the articulation angle that changes with the passage of time.

FIG. 14(B) shows the command current that changes with the passage of time.

FIG. 14(C) shows the spool position that changes with the passage of time.

At time T10, the command current starts to increase in response to the start of the operation on the lever position of steering operation member 82*a*.

At time T11, the target current is set to the prescribed value. In accordance with restriction of the rate of increase, the command current increases at the constant rate of increase such that the command current becomes equal to the target current.

At time T12, the spool position reaches the opening start position. This causes steering cylinders 11*a* and 11*b* to extend and contract, and wheel loader 1 operates such that the traveling direction changes from the neutral position at which front vehicular body portion 2*a* and rear vehicular body portion 2*b* are aligned on the straight line. If frame lock bar 18 is not attached to fixation mechanism 19, the articulation angle continues to increase.

Control unit 10 stores the command current in the opening start position (opening start current).

At time T12#, the articulation angle exceeds the maximum allowable angle.

Control unit 10 sets the command current to zero and ends the calibration mode.

With this process, when the calibration mode is executed in a case where frame lock bar 18 is not attached to fixation mechanism 19, for example, the articulation angle continues to increase and exceeds the maximum allowable angle, and thus, the command current becomes zero and the calibration mode is immediately stopped.

In the case of the scheme based on the second embodiment, the calibration mode is executed while the articulation angle is always monitored. Therefore, interference of the work machine can be avoided, which enables execution of the calibration mode without affecting the surroundings of the work machine.

In each of the embodiments above, the scheme of ending the calibration mode when articulation angle detection sensor 99 detects that the articulation angle has become equal to or larger than the prescribed angle has been described. However, an angle to be detected is not limited to the articulation angle and another angle may be detected to perform control in accordance with the same scheme.

In each of the embodiments above, the wheel loader has been described as an example of the work machine. However, the work machine is not limited to the wheel loader and other types of work machines such as a motor grader and a dump truck are also applicable.

ADDITIONAL ASPECTS

The present embodiment as described above includes the following technical ideas.

Additional Aspect 1

A work machine comprising:

a detection unit (99) that detects an articulation angle;

a hydraulic cylinder for steering (11*a*, 11*b*);

an operation apparatus (82*a*, 82*b*) that receives an input of an operation command from an operator to drive the hydraulic cylinder for steering;

a control valve (135*a*, 135*b*) that controls an amount of driving of the hydraulic cylinder for steering; and a controller (10) that outputs a command current that causes the control valve to operate in response to the operation command of the operation apparatus, wherein the controller has a calibration mode of outputting the command current and performing calibration of the command current, and in the calibration mode, the controller cuts off the command current to the control valve when the articulation angle becomes equal to or larger than a prescribed angle.

Additional Aspect 2

The work machine according to Additional Aspect 1, further comprising a steering spool (35) that adjusts an amount of supply of hydraulic oil to be supplied to the hydraulic cylinder for steering, wherein the control valve adjusts a position of a spool of the steering spool.

Additional Aspect 3

The work machine according to Additional Aspect 2, wherein the controller determines whether the operation command of the operation apparatus is equal to or larger than a first threshold value, and when the operation command of the operation apparatus is equal to or larger than the first threshold value, the controller increases a value of the command current and stores a command current when the spool reaches a prescribed position, the controller calculates a correction value of the command current corresponding to the operation command of the operation apparatus based on a value of the stored command current, and the controller determines whether the operation command of the operation apparatus is equal to or larger than a second threshold value, and when the operation command of the operation apparatus is not equal to or larger than the second threshold value, the controller sets the value of the command current to an initial value.

Additional Aspect 4

The work machine according to Additional Aspect 3, wherein the controller increases the value of the command current and stores a first command current when the spool reaches a first prescribed position, the controller increases the value of the command current and stores a second command current when the spool reaches a second prescribed position, and when the spool reaches the second prescribed position, the controller sets the value of the command current to the initial value.

Additional Aspect 5

The work machine according to Additional Aspect 3 or 4, wherein the controller increases the command current at a constant rate of increase with passage of time, the command current being a current that causes the control valve to operate in response to the operation command of the operation apparatus.

Additional Aspect 6

The work machine according to any one of Additional Aspects 3 to 5, wherein the controller sets a target current in accordance with the operation command of the operation apparatus, and adjusts the command current to increase at a prescribed rate of increase with respect to the set target current.

Additional Aspect 7

A method for controlling a work machine, the method comprising:

detecting an articulation angle (S1);

receiving an input of an operation command of an operation apparatus from an operator to drive a hydraulic cylinder for steering;

outputting a command current that causes a control valve to operate in response to the operation command (S4), the control valve being a valve that controls an amount of driving of the hydraulic cylinder for steering;

executing a calibration mode of performing calibration of the command current; and in the calibration mode, cutting off the command current to the control valve when the articulation angle becomes equal to or larger than a prescribed angle (S18).

Although the embodiments of the present disclosure have been described above, it should be understood that the embodiments disclosed herein are illustrative and non-restrictive in every respect. The scope of the present disclosure is defined by the terms of the claims, and is intended to include any modifications within the scope and meaning equivalent to the terms of the claims.

REFERENCE SIGNS LIST

1 wheel loader; 2 vehicular body frame; 2*a* front vehicular body portion; 2*b* rear vehicular body portion; 3 work implement; 4*a* front wheel; 4*b* rear wheel; 5 operator's cab; 6 boom; 7 bucket; 8 operation unit; 9 bell crank; 10 control unit; 11*a*, 11*b* steering cylinder; 12 steering pump; 13 work implement pump; 14*a*, 14*b* lift cylinder; 15 bucket cylinder; 18 frame lock bar; 19 fixation mechanism; 21 engine; 22 traveling apparatus; 23 torque converter apparatus; 24 fuel injection pump; 26 transmission; 27 lock-up clutch; 28 torque converter; 31 clutch control valve; 32 shaft; 33 PTO shaft; 34 work implement control valve; 35 steering spool; 50 display; 60 memory; 81*a* accelerator operation member; 81*b* accelerator operation detection device; 82*a* steering operation member; 82*b* steering operation detection device; 83*a* boom operation member; 83*b* boom operation detection device; 84*a* bucket operation member; 84*b* bucket operation detection device; 85*a* gear-shifting operation member; 85*b* gear-shifting operation detection device; 86*a* FR operation member; 86*b* FR operation detection device; 91 engine rotation speed sensor; 92 output rotation speed sensor; 93 input rotation speed sensor; 98 boom angle detection device; 99 articulation angle detection sensor; 135*a*, 135*b* solenoid control valve; 136 spool position sensor.

The invention claimed is:

1. A work machine comprising:

a detection unit that detects an articulation angle;

a hydraulic cylinder for steering;

an operation apparatus that receives an input of an operation command from an operator to drive the hydraulic cylinder for steering;

a control valve that controls an amount of driving of the hydraulic cylinder for steering; and a controller that outputs a command current that causes the control valve to operate in response to the operation command of the operation apparatus, wherein the controller has a calibration mode of outputting the command current and performing calibration of the command current, and in the calibration mode, the controller cuts off the command current to the control valve when the articulation angle becomes equal to or larger than a prescribed angle.

2. The work machine according to claim 1, further comprising a steering spool that adjusts an amount of supply of hydraulic oil to be supplied to the hydraulic cylinder for steering, wherein the control valve adjusts a position of a spool of the steering spool.

3. The work machine according to claim 2, wherein the controller determines whether the operation command of the operation apparatus is equal to or larger than a first threshold value, and when the operation command of the operation apparatus is equal to or larger than the first threshold value, the controller increases a value of the command current and stores a command current when the spool reaches a prescribed position, the controller calculates a correction value of the command current corresponding to the operation command of the operation apparatus based on a value of the stored command current, and the controller determines whether the operation command of the operation apparatus is equal to or larger than a second threshold value, and when the operation command of the operation apparatus is not equal to or larger than the second threshold value, the controller sets the value of the command current to an initial value.

4. The work machine according to claim 3, wherein the controller increases the value of the command current and stores a first command current when the spool reaches a first prescribed position, the controller increases the value of the command current and stores a second command current when the spool reaches a second prescribed position, and when the spool reaches the second prescribed position, the controller sets the value of the command current to the initial value.

5. The work machine according to claim 3, wherein the controller increases the command current at a constant rate of increase with passage of time, the command current being a current that causes the control valve to operate in response to the operation command of the operation apparatus.

6. The work machine according to claim 3, wherein the controller sets a target current in accordance with the operation command of the operation apparatus, and adjusts the command current to increase at a prescribed rate of increase with respect to the set target current.

7. A method for controlling a work machine, the method comprising:

detecting an articulation angle;

receiving an input of an operation command of an operation apparatus from an operator to drive a hydraulic cylinder for steering;

outputting a command current that causes a control valve to operate in response to the operation command, the control valve being a valve that controls an amount of driving of the hydraulic cylinder for steering;

executing a calibration mode of performing calibration of the command current; and in the calibration mode, cutting off the command current to the control valve when the articulation angle becomes equal to or larger than a prescribed angle.

* * * * *